US006712601B2

(12) United States Patent
Cessac

(10) Patent No.: US 6,712,601 B2
(45) Date of Patent: Mar. 30, 2004

(54) LOW POWER STARTER FOR CATALYTIC HEATERS

(75) Inventor: Kevin J. Cessac, Houston, TX (US)

(73) Assignee: PGI International, Ltd., Houston, TX (US)

( * ) Notice: Subject to any disclaimer, the term of this patent is extended or adjusted under 35 U.S.C. 154(b) by 50 days.

(21) Appl. No.: 10/000,664

(22) Filed: Oct. 31, 2001

(65) Prior Publication Data

US 2003/0082493 A1 May 1, 2003

(51) Int. Cl.[7] ..... F23N 5/20; F23D 14/12

(52) U.S. Cl. ..... 431/6; 431/7; 431/328; 126/92 C

(58) Field of Search ..... 431/6, 7, 328, 431/170, 208; 126/92 AC, 92 C; 60/776, 777

(56) References Cited

U.S. PATENT DOCUMENTS 3,784,353 A * 1/1974 Chapurin ..... 431/329
3,833,338 A 9/1974 Badrock
3,880,235 A 4/1975 Berry et al.
3,901,213 A * 8/1975 Charboneau ..... 122/21
3,911,896 A * 10/1975 Charboneau et al. ..... 122/21
5,037,293 A 8/1991 Kirby
5,423,669 A * 6/1995 Chapman ..... 425/143
5,993,192 A 11/1999 Schmidt et al.
6,092,765 A * 7/2000 White ..... 244/117 R

FOREIGN PATENT DOCUMENTS

JP 61-83818 * 4/1986

* cited by examiner

*Primary Examiner*—Alfred Basichas
(74) *Attorney, Agent, or Firm*—Loren G. Helmreich; Browning Bushman, P.C.

(57) ABSTRACT

A catalytic heater 10 has an insulation pad 36 and a catalyst pad 34 mounted in face-to-face relation within an enclosure 11 having an open front face 20. A starter 48 is mounted within the catalyst pad and is effective for preheating of the catalyst pad. Fuel gas is supplied to the rear face of the insulation pad and air is supplied to the front face of the catalyst pad, so that a catalytic reaction occurs generally when the catalyst pad and sear the ope front face. After the catalytic reaction begins, electrical energy is ceased to the starter. The starter preferably comprises a quartz-halogen lamp of a relatively small size which is mounted within the catalyst pad.

62 Claims, 5 Drawing Sheets

LOW POWER STARTER FOR CATALYTIC HEATERS

FIELD OF THE INVENTION

This invention relates to infrared catalytic heaters and, more particularly, to a preheater or starter for an infrared catalytic heater.

BACKGROUND OF THE INVENTION

Catalytic heaters employ a catalyst bed that results in flame-less combustion of the fuel and the creation of infrared energy. Since combustion is flame-less, these heaters may operate at a temperature that is lower than the ignition temperature of the fuel to the heater, which is typically natural gas or propane. Catalytic heaters are particularly well suited for applications desiring explosion proof operation, such as various applications involving the natural gas industry. In a typical catalytic heater, a catalyst bed is heated to a temperature of about 250° F. at which time a thermostat valve is opened so that the supplied fuel and oxygen form the desired reaction with the catalyst bed.

One method used to start the heater is to supply fuel to the back of the catalyst pad while heating a portion of the surface of the catalyst bed with a flame, such as shown in U.S. Pat. No. 5,993,192. After the reaction is established, the flame is removed. The open flame starting method is more dangerous than the electric heater starter and is not acceptable for use in many hazardous locations.

Infrared catalytic heaters normally require the catalyst pad or bed to be heated above the activity temperature of about 250° F. to start the catalytic reaction. A resistive electric heating element located between the catalyst pad and the insulation pad is commonly used to preheat the catalyst above the activity temperature. When the catalyst is hot enough, i.e., at or above the activity temperature, fuel enters the back of the heater while oxygen from the air is diffused through the front. When the oxygen and fuel converge in the catalyst, an oxidation reaction takes place resulting in a flame-less combustion and creating infrared energy. After the oxidation reaction begins, power to the electric heating element can be removed and the reaction will continue until either the fuel supply or the oxygen is eliminated.

A 6 inch by 6 inch square heater will typically use a 150 Watt, 0.30 inch diameter, heating element forming a 4 inch diameter circle between the catalyst pad and the insulating pad. Power is applied to the electric starter element for 15 to 20 minutes to preheat the catalyst pad. To start the 6 inch by 6 inch heater requires 37.5 Watt/hours (150 Watts×0.25 hours=37.5 Wh). If a 12 volt battery is used to power the starter, over 3 Amp/hours is used every time the heater is started (37.5 Wh/12 volts=3.12 h). Larger heaters will use more power because the starting element is larger. For example, a 24 inch by 36 inch heater made by CCI Thermal Technologies Inc. of Alberta, Canada, requires a 1200 Watt starting element. After the 15 minute warmup, propane or natural gas is supplied to the back of the heater at a controlled flow rate and the catalytic reaction begins. After the reaction is fully established, power to the starting heater is removed.

When infrared catalytic heaters are used in hazardous locations, such as gas pipeline equipment, the power source for the electric heating element must be located away from the catalytic heater and in a safe location. Typically the electric connections for the starter heater are made in an explosion-proof housing on the back of the heater and then conductors run through rigid conduit to the safe area which can be 25 feet or more away from the heater. Lowering the maximum output of the starter power source results in a smaller power source, and smaller wire and conduit to connect the power source to the heating element, thereby significantly reducing the installation cost and increasing safety, especially for the high power heaters.

The disadvantages of the prior art are overcome by the present invention, and a catalytic heater with an improved electrically powered starter and method of starting and controlling the catalytic heater as hereinafter disclosed.

SUMMARY OF THE INVENTION

In a preferred embodiment, the starter for the infrared catalytic heater utilizes a low cost, low power quartz-halogen lamp to preheat a small section of a catalyst pad to the activity temperature. Several unique features of the halogen lamp make it an efficient starter for the catalyst pad. The lamp envelope is small to reduce the amount of halogen gas required and reduce the cost of the lamp. The small envelope also keeps the tungsten element close to the lamp walls, thereby allowing high heat transfer to the envelope. The heating element is hermetically sealed inside the quartz envelope, thereby eliminating corrosion issues associated with conventional resistive elements.

The starter is preferably inserted into the side of the catalyst pad and spaced closer to the catalyst exterior face than to the front face of the insulation, so that the starter is surrounded by catalyst pad material. Only a small section of the pad need be preheated to the activity temperature for the catalytic reaction. After the reaction begins in the starter area, the heat generated by the exothermic catalytic reaction spreads across the catalyst pad and the startup is complete. Power to the starter is removed after partial catalyst activity takes place to maximize power savings.

The low power requirements of the quartz-halogen starter make it possible to include a small battery pack in an explosion-proof box near the heater for the starter power. This eliminates the long conductor wire and conduit run to the safe area for the starter power source, thereby enabling the heater to be a self-contained unit.

It is an object of this invention to provide a catalytic heater with an improved low power preheater or starter.

A further object of the invention is the provision of such a starter that heats a relatively small portion of the catalyst pad to the desired temperature in a minimum of time. Less than 2% of the flow through area of the pad preferably defines the perimeter area of the heating element, while in the prior art the perimeter area of the heating element was typically 50% or more of the catalyst pad flow through area. The cross-sectional of the heating element itself relative to the flow through area of the pad is also very small, and preferably is less than 2% of the flow through area of the catalytic pad. The wattage for the electrically powered heating element is low relative to the wattage of prior art catalytic starters, and according to the present invention is less than 15 watts regardless of the flow through area for the catalytic pad.

These and further objects, features, and advantages of the invention will be apparent from the following specification, wherein reference is made to the figures in the accompanying drawings.

DETAILED DESCRIPTION OF PREFERRED EMBODIMENTS

Figure 1:
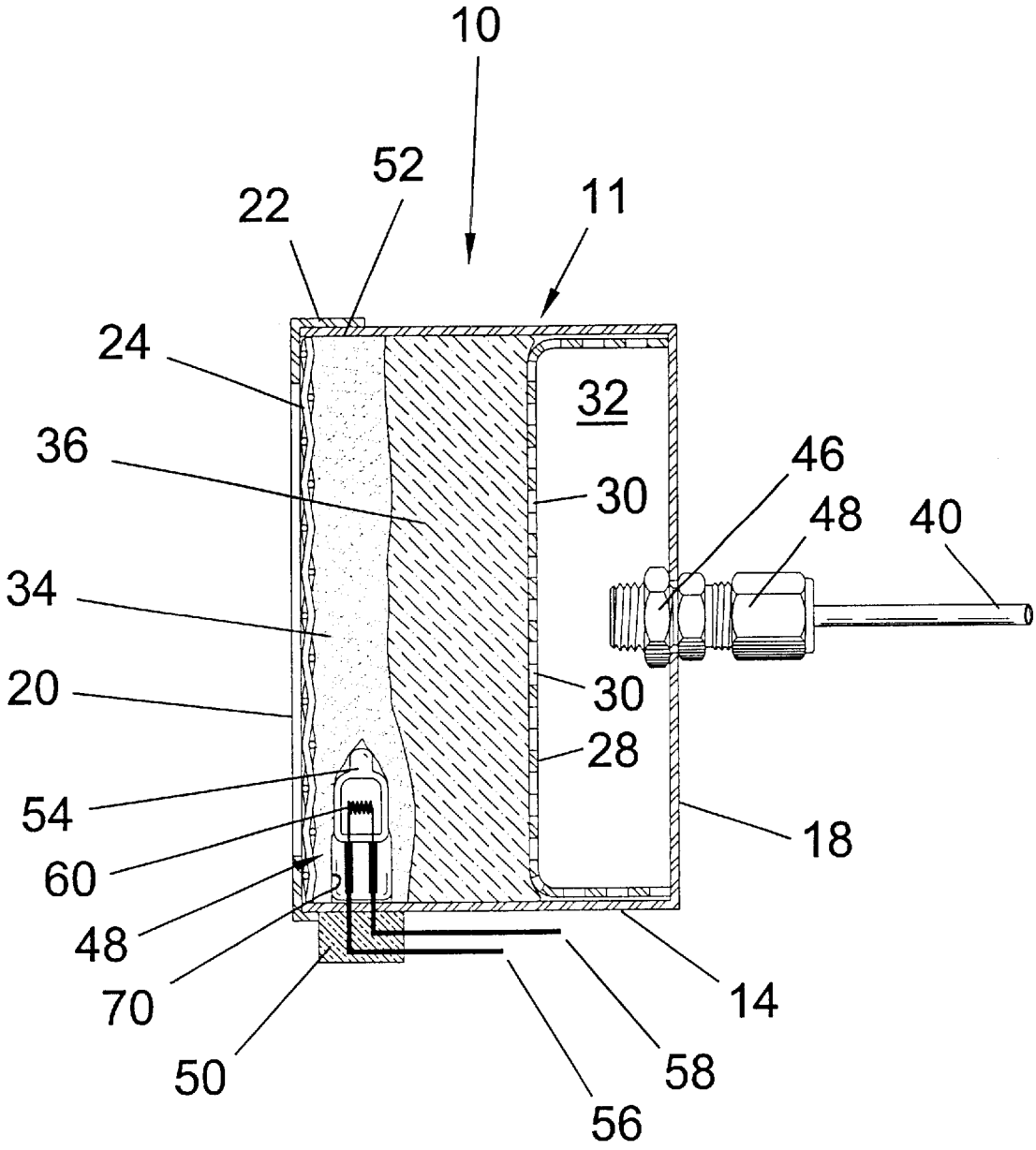
FIG. 1 is a cross-sectional view of one embodiment of a catalytic heater with an electronically powered starter according to the present invention.
Figure 2:
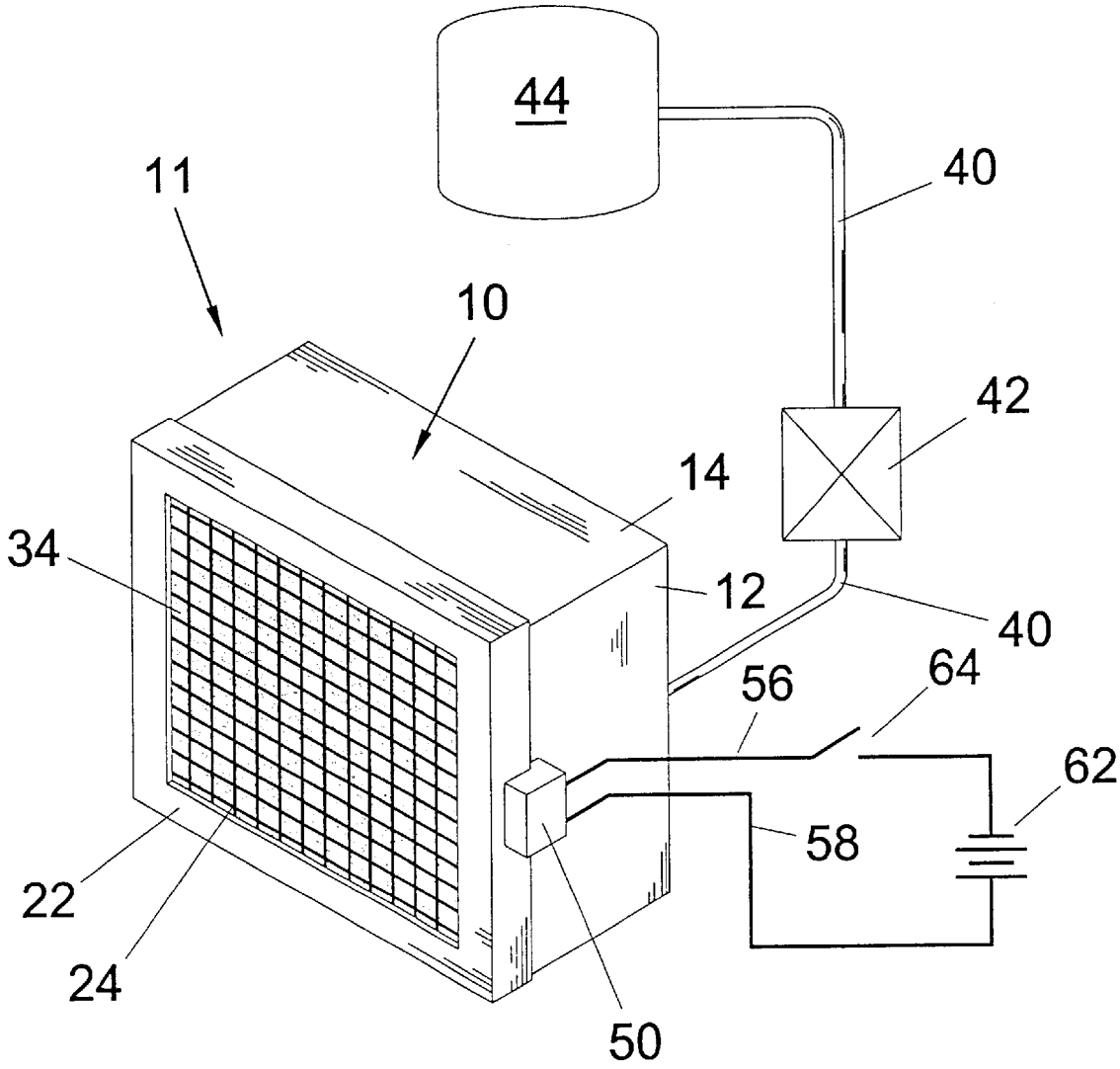
FIG. 2 is a schematic view of a catalytic heater system for controlling the operation of the catalytic heater and electronic starter shown in FIG. 1.

Referring FIGS. 1 and 2, a catalytic heater 10 includes a generally rectangular enclosure or housing 11 having opposed left and right sidewalls 12, and opposed upper and lower walls 14. The enclosure includes a rear wall 18 to form a compartment having a generally open front face 20. A rectangular front frame 22 fits about walls 12 and 14 and defines the perimeter of the open front face 20, i.e., the flow through area of the catalytic pad. A screen 24 typically fits inside frame 22. A rear channel-shaped plate 28 fits against rear wall 18 and has perforations 30 therein. A chamber 32 is thus formed between rear wall 18 and plate 28.

Fitting between front screen 24 and rear screen 28 are the generally rectangular-shaped catalyst pad 34 and an insulation panel or pad 36. The catalyst pad 34 typically engages the front screen 24 on its front side, and engages the insulation pad 36 on its rear side. The rear side of the insulation pad typically engages the rear plate 28. Insulation or diffusion pad 36 may comprise a ceramic fiber blanket, and serves to diffuse the fuel gas across the flow through area of the catalytic pad.

A fuel gas, either natural gas or propane, is supplied through tubing line 40 to chamber 32 from a fuel storage tank 44, which alternatively may be a pipeline. Tubing line 40 has a tubing fitting 48 and is connected by lock nuts 46 to rear wall 18. Valve 42 controls the flow of fuel gas to chamber 32, with the fuel gas being supplied at a regulated pressure and flow rate to chamber 32 from fuel storage tank 44 by the valve 42. The pressure of the fuel gas typically increases in chamber 32 and flows evenly through openings 30 in perforated plate 28. Insulation pad 36 distributes the fuel gas evenly across the catalyst pad 34. Oxygen from ambient air passes through screen 24 from open front 20 and enters catalyst pad 34. This catalytic reaction produces a flame-less heating, as described in U.S. Pat. Nos. 5,037,293 and 5,993,192.

The starter 48 for preheating catalyst pad 34 prior to the supply of fuel gas as illustrated in FIGS. 1 and 2 is a quartz-halogen lamp, although the starter may be formed of a small resistive wire element to preheat a small section of catalyst pad 34 above the activation temperature. Catalyst pad 34 conventionally has four sides 52. A pocket 70 is formed having an entrance opening in a side 52 of pad 34. The pocket entrance opening may be provided in the bottom side of the catalyst pad 34, or in the right side, left side, or top side of the pad, depending on the position of related equipment to the enclosure. Pocket 70 preferably is spaced from insulation pad 36, and is thus positioned entirely within the catalyst pad. A majority of the pocket 70, preferably at least 90% of the pocket 70, and most preferably all of the pocket 70 is thus within the catalyst pad. Starter 48 is then positioned within pocket 70 in catalyst pad 34 and is surrounded by catalyst pad 34 while being spaced from insulation pad 36.

Starter 48 may be supported by a base or socket 50 mounted on wall 14. For best results, starter 48 may be spaced at least about 0.05 inches and preferably about 0.1 inches from the front face of insulation catalyst pad 36. As shown in FIG. 1, the starter extends from one wall (lower wall toward the opposing wall (top wall) a spacing of less than ⅓ the opening between the opposing walls, and preferably a spacing of less than 20% of the spacing between the mounting wall for the starter and the opposed wall.

Starter 48 is a quartz-halogen lamp with electrical wires 56 and 58 powering a resistive element 60. Heating element 60 is hermetically sealed inside a quartz envelope 54 to eliminate corrosion. Power from battery 62 flows through closed switch 64 and wire 56 to starter 48 and back to battery 62 through wire 58. Pocket 70 may be of a generally cylindrical shape and may have a width less than about 80%, and preferably about 60%, of the thickness of pad 34. It should be understood that the pocket 70 may be formed simply by inserted the bulb 48 into a conventional catalyst pad having a uniform thickness, so that the insertion of the bulb 48 slightly increases the thickness of the pad adjacent the bulb. It is thus not necessary to preform a pocket in the catalyst pad prior to inserting the lamp to the position shown in FIG. 1.

A quartz-halogen lamp is a low power, low cost element which may be used to preheat a small section of catalyst pad 34 to the activity temperature normally about 250° F. Several styles and sizes of quartz-halogen lamps and high temperature lamp sockets are readily available. An example of an acceptable quartz halogen lamp is part number Q5T3/CL from GE Lighting. A suitable socket is part number 27-07 from Leecraft Lighting Company.

Since starter 48 may be surrounded by catalyst pad 34, the catalytic reaction spreads across catalyst pad 34 beginning in the area adjacent starter 48 for fully heating catalyst pad 34 and thereby complete the preheating of pad 34. The catalyst pad 34 may be heated to the oxidation activity temperature of 250° F. in less than 60 seconds with the entire 6 inch×6 inch pad fully active in less than 3 minutes. Valve 46 is then opened (or may be opened any time after the starter 48 is activated) to start the flow of fuel gas to heater 10. Fuel gas enters rear chamber 32 from line 40 and oxygen enters the open face of heater 10 through screen 24. The oxidation reaction will begin when the catalyst pad temperature 34 is heated above 250° F. by starter 48. After the oxidation reaction begins, switch 64 can be opened to remove power from starter 48. The preheating of catalyst pad 34 spreads the oxidation reaction across the entire surface of catalyst pad 34 to fully start heater 10.

Fully heating the catalyst pad before supplying fuel reduces the amount of unburned hydrocarbons during startup, but is not necessary to reliably start the reaction. Catalytic heaters must be well vented to exhaust unburned fuel and supply new oxygen to the catalyst. For every square foot of heater surface area, 60 cubic feet per hour of air supply is required to sustain the reaction. The small amount of unburned fuel is vented with the other exhaust gases during warmup as fresh air replenishes oxygen to the catalyst.

Figure 6:
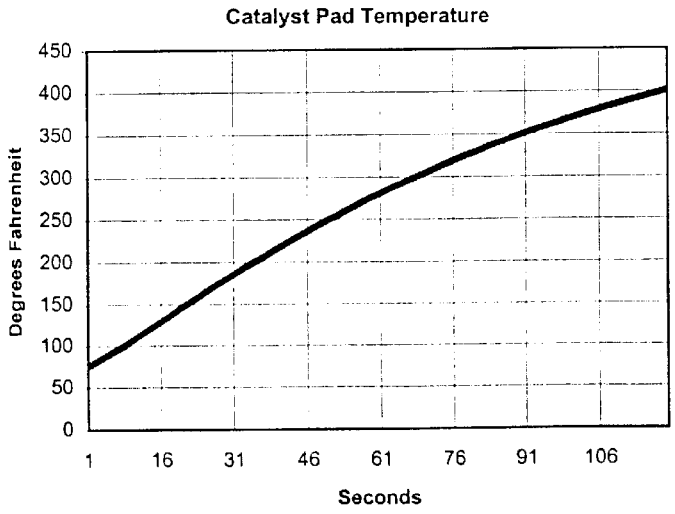
FIG. 6 is a graph illustrating the warmup time for a catalyst pad starter according to the present invention.

Using a 10 Watt quartz-halogen starter, the catalyst pad may be heated to the activity temperature (250° F.) in less than 60 seconds and the entire 6 inch×6 inch pad is fully active in less than 3 minutes. The graph as shown in FIG. 6 illustrates the warmup time in seconds required for heating the catalyst pad starter to a specified temperature. As shown in FIG. 6, the catalyst pad reaches the 250° F. activity temperature in about 50 seconds.

Starter power required to start the 6 inch×6 inch heater is (10 Watts×0.05 Hours=0.5) 0.5 Watt/hours. Using a 12 volt power source which provides (0.5 Wh/12V=0.04 Ah) 0.04 Amp/Hours for the 6 inch×6 inch heater, the quartz-halogen starter requires 0.5 Watt/hours, compared to 37.5 Watt/hours for the resistive element starter. Startup time is reduced from 15–20 minutes to 2–3 minutes. A quartz-halogen lamp of less than about 15 watts should be sufficient for most applications, and a lamp sized to receive less than 10 watts of power is desired for many applications.

A small 12 volt 1.3 Ah lithium battery pack could be used to supply enough power to start a heater with a 6 inch×6 inch catalyst pad over 30 times. The same starter will work for heaters with larger catalyst pads. Larger heaters will take longer for the catalyst activity to propagate throughout the pad during startup, and initially have more unburned hydrocarbons. Full activity startup time for larger heaters may be improved by using multiple starters spaced evenly around the catalyst pad. Multiple starters also add redundancy to the starter system thereby allowing the heater to start if one or more of the starters fail due to a burned out element.

While the preferred starter is the quartz-halogen lamp, a small low power, resistive element heater, e.g., 5 to 10 watt, may provide acceptable performance. The quartz-halogen starter is more readily available, can be easily mounted and serviced, and is low cost. In high volume applications, a custom resistive cartridge heater may become cost competitive.

As a result of having starter 48 mounted entirely within catalyst pad 34 and surrounded by catalyst pad 34, a large catalyst active area is heated faster to decrease the startup time. It is necessary only to preheat the catalyst pad 34 as it is not necessary to preheat insulation pad 36. Since pocket 70 is arranged entirely within catalyst pad 34, maximum utilization of the heating energy from starter 48 is obtained. It may be desirable in some instances to have more than one starter 48 for catalyst pad 34 in the event of failure of a starter, e.g., such as a burned out element.

Figure 5:
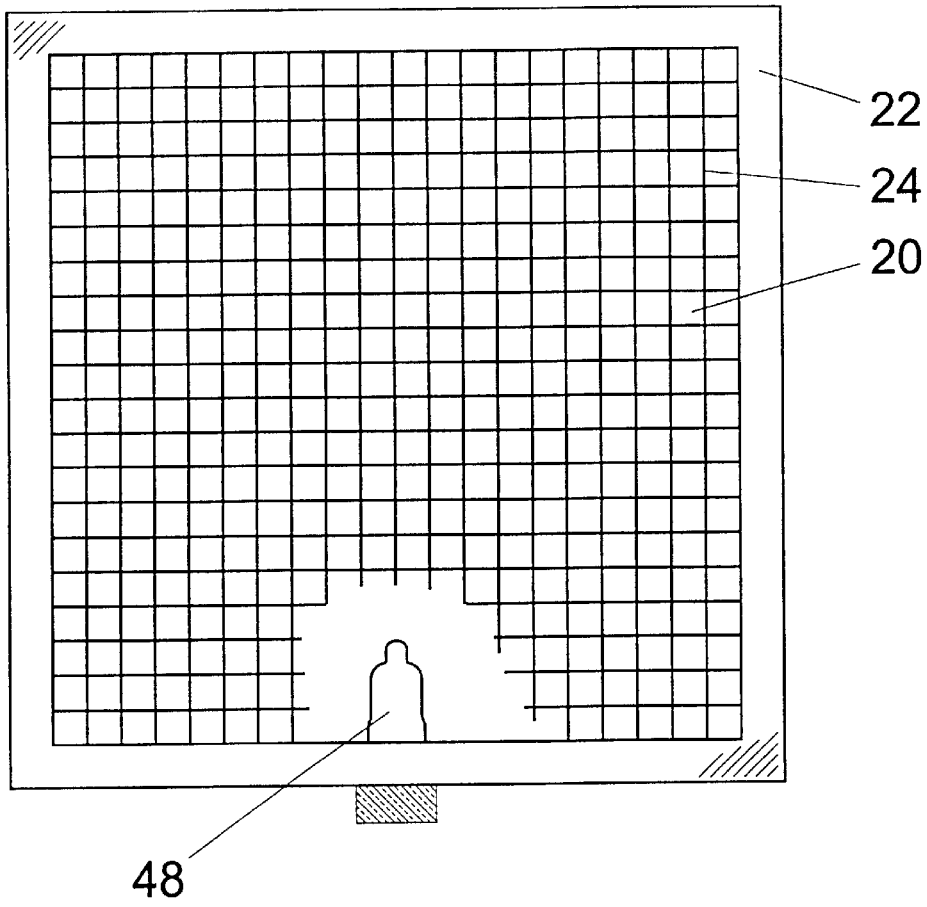
FIG. 5 is a front view of the flow through area of the catalyst pad, illustrating the size of the starter relative to the pad flow through area.

It is a particular feature of the present invention that the size of the starter 48 is substantially reduced compared to prior art starters. A conventional starter for a catalyst pad is typically in the form of a open ended loop which effectively defines a perimeter area of the heating element. A resistive heating element could have other configurations, but regardless of the configuration of the heating element, the heating element forms a generally circular, oval, or rectangular shaped perimeter which defines the outer boundary of the heating element. For most prior art applications, this perimeter size of the heating element is more than 50% of the cross-sectional flow through area of the catalyst pad, and in many applications is at least 60% of the catalyst pad flow through area. FIG. 5 shows the size of a starter 48 according to the present invention relative to the open front face 20, which is the flow through area for the catalytic pad. FIG. 1 discloses the concept of the present invention, but the size of the starter 48 is not to scale with the size of the enclosure. FIG. 5 shows the starter at the same scale as the frame 22. The frame 22 thus defines the boundaries of the flow through area of the catalyst pad, which typically extends outward from the edges of the frame 22 to substantially the side walls of the closure 11. According to the present invention, the electronic starter 48 has a cross-sectional area less than 2% of the flow through area 20, and many applications will be less than about 1% and may be 0.5% or less of the flow through area. Turning now to a discussion of the actual cross-sectional area of the heating element relative to the flow through area 20, the prior art heating elements generally had a cross-sectional area of about 10% of the flow through area. According to the present invention as discussed above, the cross-sectional area of the heating element typically would be less than 2% of the flow through area.

Figure 3:
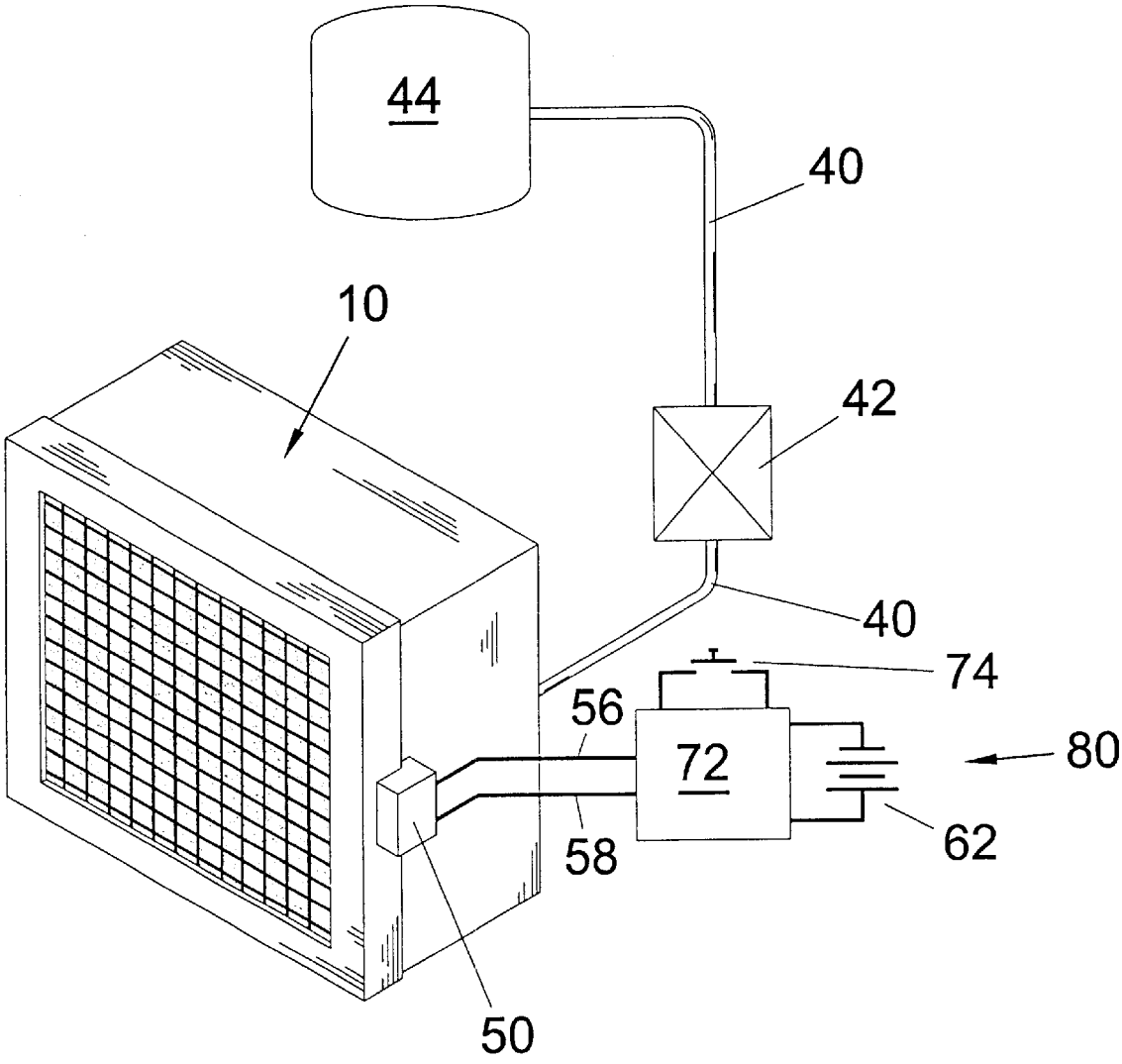
FIG. 3 is a schematic view of a modified catalytic heater system for controlling the operation of the catalytic heater and electronic starter shown in FIG. 1.

FIG. 3 discloses a control system 80 for heater 10 which is similar to the control system of FIG. 2, except for the elimination of manual switch 64 and substitution of an automatic timer 72. A pushbutton 74 is provided for starting timer 72. To start preheater or starter 48, pushbutton 72 is pressed and released. The electronic timer circuit in timer 72 closes the power circuit between battery 62 and leads 56 and 58. Gas valve 42 may be manually opened to supply fuel to catalyst pad 24. After a delay of about 2 or 3 minutes, timer 72 is stopped automatically to open the power circuit and stop the supply of power to starter 48.

Figure 4:
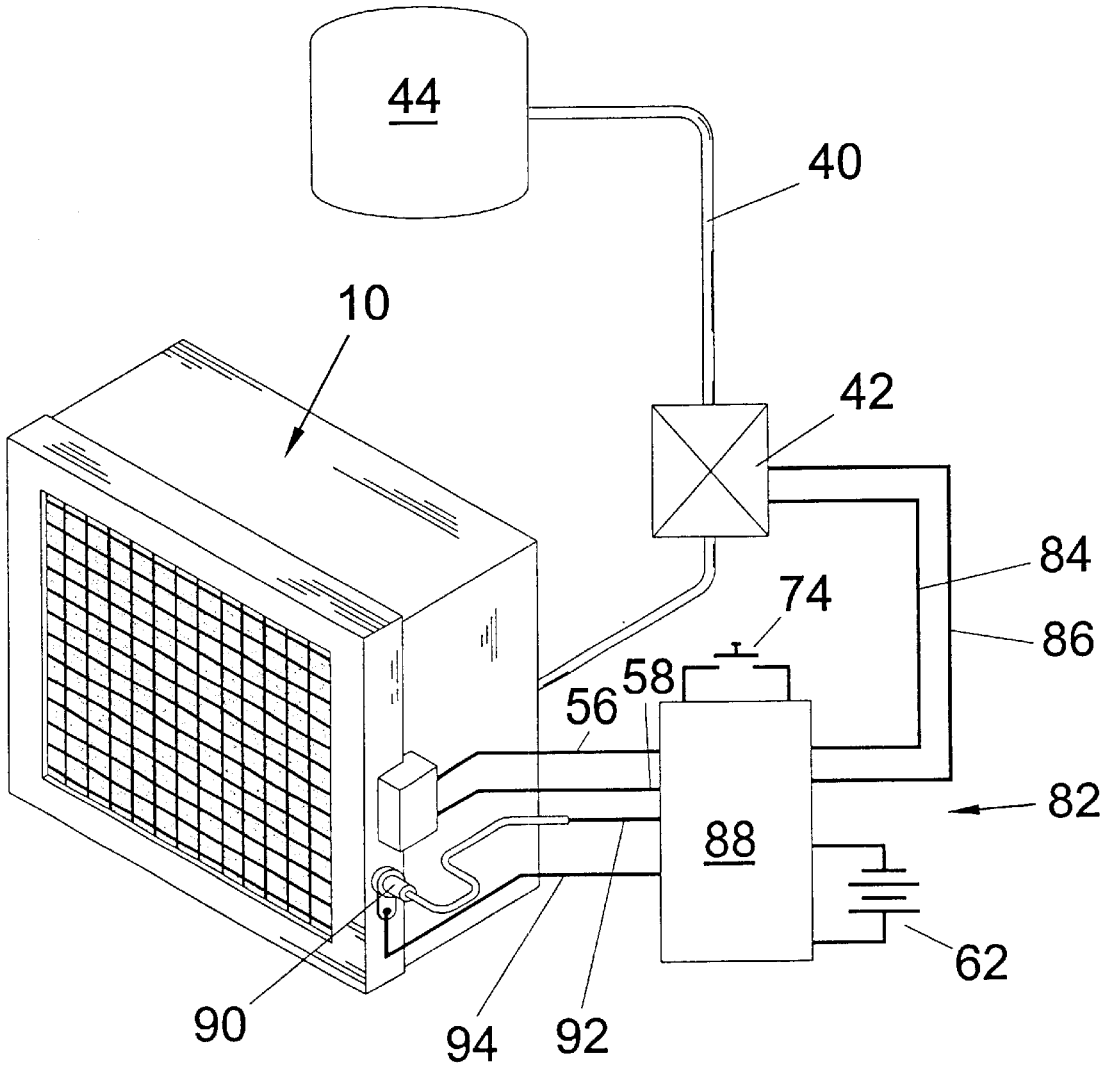
FIG. 4 is a schematic of a further modified catalytic heater system for controlling the operation of the catalytic heater and electronic starter shown in FIG. 1.

A further embodiment of the starter control system 82 is shown in FIG. 4. Fuel gas is supplied by fuel supply 44 through line 40 to heater 10. Electronic lines 84 and 86 extend from starter controller 88 to solenoid operated valve 42. A temperature sensor 90 for sensing the catalytic reaction is connected to the controller 88 by lines 92 and 94. Battery 62 supplies power to controller 88 and to starter 48 through lines 56 and 58.

In operation, pushbutton 74 is pressed to apply power to solenoid valve 42 for opening valve 42 for the supply of fuel gas to heater 10. Power is simultaneously provided to starter 48 through lines 56 and 58. When temperature sensor 90 senses that the catalytic reaction has been started, power to starter 48 is stopped. Temperature sensor 90, which alternatively may be a thermocouple, is also effective to detect when the catalytic reaction is no longer occurring. When the catalytic reaction ceases as sensed by temperature sensor 90, starter controller 88 is effective to close solenoid operated valve 42 and stop the flow of fuel gas to heater 10.

Another embodiment of a starter control system includes a manually operated fuel valve 42 with a thermocouple connected thereto heated by the catalyst pad of the heater. The fuel valve 42 is manually held in an open position until the thermocouple is heated by the catalyst pad to a predetermined temperature sufficient to produce the power required to maintain the valve in an open position. An electric switch for the fuel valve provides power to the starter 48 through a controller when the fuel valve is manually actuated. If the catalytic reaction stops and heater 10 cools, power from the thermocouple is reduced to close valve 42 for shutting off the fuel supply to heater 10.

From the above, it is apparent that a starter has been provided which is utilized for preheating only a small portion of catalyst pad 34. Starter 48 is preferably a relatively small device such as a quartz-halogen lamp having a resistive wire element which is effective for preheating a small portion of the catalyst pad 34 above the activation temperature which may be about 250° F. Starter 48 is inserted within a side of the catalyst pad 34, which surrounds the starter to provide a fast startup time.

Various control systems may be utilized for providing power to the starter and to the heater as exemplified by the starter control system embodiments shown in FIGS. 2–4. A small, low power, starter substantially surrounded by the catalytic pad has been found to be highly effective in preheating a relatively large portion of the catalytic pad.

It will be appreciated that various modifications can be made in the design, construction and operation of the present inventions without departing from the spirit or scope of such inventions. Thus, while the principal preferred construction and mode of operation of the inventions have been explained in what is now considered to represent their best embodiments, which have been illustrated and described herein, it will be understood that within the scope of the appended claims, the inventions may be practiced otherwise than as specifically illustrated and described.

What is claimed is:

1. A catalytic heater fueled by a combustible gas source, comprising:

a housing defining an enclosure having an open front face;

a fuel inlet line having a fuel discharge within a rear portion of said enclosure;

a diffusion pad within said enclosure spaced between said open front face and said fuel discharge, a rear face of said diffusion pad being supplied with fuel gas for providing a catalytic reaction;

a catalyst pad spaced opposite said fuel inlet line relative to said diffusion pad and positioned within said enclosure adjacent said open front face, said catalyst pad having a rear face adjacent a front face of said diffusion pad and a front face exposed to ambient air from said open front face of said enclosure; and an electrically powered starter for preheating said catalyst pad, said starter being positioned within a pocket extending from an entrance opening in a side face of said catalyst pad, a majority of said pocket being spaced from said catalyst pad;

wherein said starter comprises a quartz-halogen lamp inserted within said pocket.

2. The catalytic heater as defined in claim 1, wherein said pocket is enclosed by said catalyst pad.

3. The catalytic heater as defined in claim 1, further comprising:

a perforated plate adjacent the rear face of said diffusion pad, whereby a fuel gas is supplied to said perforated plate for passing through said diffusion pad.

4. The catalytic heater as defined in claim 3, further comprising:

a fuel gas chamber within said enclosure adjacent said perforated plate, said fuel discharge positioned within said chamber for passing through said perforated plate.

5. The catalytic heater as defined in claim 4, wherein said enclosure has a rectangular shape and has a rear wall spaced from said perforated plate to define said fuel gas chamber between said rear wall and said perforated plate.

6. The catalytic heater as defined in claim 1, wherein said starter has a wattage of less than about 15 watts.

7. The catalytic heater as defined in claim 1, wherein said catalyst pad has a rectangular shape and said starter extends within a side of said catalyst pad a distance less than about ⅓ a spacing between said side and an opposing side of said catalyst pad.

8. The catalytic heater as defined in claim 1, wherein the starter has a width less than about 80% of a thickness of the catalyst pad.

9. The catalytic heater as defined in claim 1, further comprising:

a portable source of electrical energy adjacent said housing to supply electrical energy to said starter for preheating of said catalyst pad.

10. The catalytic heater as defined in claim 9, further comprising:

a timer for said source of electrical energy to supply electrical energy to said starter for a selected time period sufficient to heat the catalytic pad to a selected temperature.

11. The catalytic heater as defined in claim 1, further comprising:

a solenoid operated valve to control the supply of gas from said pipeline to said fuel gas chamber.

12. The catalytic heater as defined in claim 11, further comprising:

a controller to permit a selected supply of electrical energy to said solenoid operated valve, said controller effective to close said solenoid operated valve and stop the supply of fuel gas to said heater when the temperature of the catalytic reaction in said heater has reached a predetermined level.

13. The catalytic heater as defined in claim 12, further comprising:

a temperature sensor to sense the temperature of the catalytic reaction in said heater, said controller responsive to said temperature sensor to close said valve and stop the supply of fuel gas to said heater.

14. The catalytic heater as defined in claim 13, wherein said controller is effective to stop the supply of electrical energy to said starter upon said temperature sensor sensing the catalytic reaction reaching a selected temperature.

15. A catalytic heater fueled by a combustible gas source, comprising:

a housing defining an enclosure having an open front face;

a fuel inlet line having a fuel discharge within a rear portion of said enclosure;

a diffusion pad within said enclosure spaced between said open front face and said fuel discharge, a rear face of said diffusion pad being supplied with fuel gas for providing a catalytic reaction;

a catalyst pad spaced opposite said fuel inlet line relative to said diffusion pad and positioned within said enclosure adjacent said open front face, said catalyst pad having a rear face adjacent a front face of said diffusion pad and a front face exposed to ambient air from said open front face of said enclosure; and an electrically powered starter for preheating said catalyst pad, said starter having a perimeter area less than about 2% of a flow through area of the catalyst pads;

wherein said starter comprises a quartz-halogen lamp inserted within said pocket.

16. The catalytic heater as defined in claim 15, wherein said starter is enclosed by said catalyst pad.

17. The catalytic heater as defined in claim 15, wherein said starter has a wattage of less than about 15 watts.

18. The catalytic heater as defined in claim 15, wherein said catalyst pad has a rectangular shape and said starter extends within a side of said catalyst pad a distance less than about ⅓ a spacing between said side and an opposing side of said catalyst pad.

19. The catalytic heater as defined in claim 15, wherein the starter has a cross-sectional area less than about 2% of the flow through area of the catalyst pad.

20. The catalytic heater as defined in claim 15, further comprising:

a portable source of electrical energy adjacent said housing to supply electrical energy to said starter for preheating of said catalyst pad.

21. A method for controlling the heating of a catalytic heater having a catalyst pad and an adjacent diffusion pad within an enclosure having an open front face defining a catalyst pad flow through area, said method comprising:

mounting a quartz-halogen lamp starter within said catalyst pad for preheating said catalyst pad, said starter having a wattage of less than about 15 watts;

supplying a fuel gas to said heater for passing through said diffusion pad and said catalyst pad for mixture with air from said open front face of said enclosure;

providing less than about 15 watts of electrical energy to said starter; and stopping the supply of electrical energy to said starter upon heating of said catalyst pad to a selected temperature.

22. The method as defined in claim 21, further comprising:

mounting said starter completely within said catalyst pad and spaced from said diffusion pad.

23. The method as defined in claim 19, further comprising:

providing the starter with a cross-sectional area less than 2% of the catalyst pad flow through area.

24. The method as defined in claim 21, further comprising:

providing the starter with a wattage of less than about 15 watts, and providing less than about 15 watts of electrical energy to said starter.

25. The method as defined in claim 21, wherein the catalyst pad has a rectangular shape and said starter extends within a side of said catalyst pad a distance less than about ⅓ of spacing between said side and an opposing side of said catalyst pad.

26. The method as defined in claim 21, further comprising:

providing a temperature sensor to sense the temperature of the catalytic reaction; and stopping the supply of electrical power to said starter in response to the temperature sensor.

27. The method as defined in claim 21, further comprising:

providing a solenoid operated valve to control the supply of fuel gas to said heater; and controlling electrical energy to said solenoid operated valve to close said solenoid operated valve and stop the supply of fuel gas to said heater.

28. The method as defined in claim 21, further comprising:

providing a timer for said source of electrical energy to said starter for ceasing the supply of electrical energy to said starter after a selected time period.

29. A catalytic heater fueled by a combustible gas source, comprising:

a housing defining an enclosure having an open front face;

a fuel inlet line having a fuel discharge within a rear portion of said enclosure;

a diffusion pad within said enclosure spaced between said open front face and said fuel discharge, a rear face of said diffusion pad being supplied with fuel gas for providing a catalytic reaction;

a catalyst pad spaced opposite said fuel inlet line relative to said diffusion pad and positioned within said enclosure adjacent said open front face, said catalyst pad having a rear face adjacent a front face of said diffusion pad and a front face exposed to ambient air from said open front face of said enclosure, the catalyst pad having a starter pocket less than about 2% of a catalyst pad area; and an electrically powered starter for preheating said catalyst pad, said starter being positioned within the pocket extending from an entrance opening in a side face of said catalyst pad, a majority of said pocket being spaced from said diffusion pad.

30. The catalytic heater as defined in claim 29, wherein said pocket is enclosed by said catalyst pad.

31. The catalytic heater as defined in claim 29, further comprising:

a perforated plate adjacent the rear face of said diffusion pad, whereby a fuel gas is supplied to said perforated plate for passing through said diffusion pad.

32. The catalytic heater as defined in claim 31, further comprising:

a fuel gas chamber within said enclosure adjacent said perforated plate, said fuel discharge positioned within said chamber for passing through said perforated plate.

33. The catalytic heater as defined in claim 29, wherein said catalyst pad has a rectangular shape and said starter extends within a side of said catalyst pad a distance less than about ⅓ a spacing between said side and an opposing side of said catalyst pad.

34. The catalytic heater as defined in claim 29, wherein the starter has a width less than about 80% of a thickness of the catalyst pad.

35. The catalytic heater as defined in claim further comprising:

a portable source of electrical energy adjacent said housing to supply electrical energy to said starter for preheating of said catalyst pad.

36. The catalytic heater as defined in claim 29, further comprising:

a timer for said source of electrical energy to supply electrical energy to said starter for a selected time period sufficient to heat the catalytic pad to a selected temperature.

37. The catalytic heater as defined in claim 29, further comprising:

a solenoid operated valve to control the supply of gas from said pipeline to said fuel gas chamber.

38. The catalytic heater as defined in claim 37, further comprising:

a controller to permit a selected supply of electrical energy to said solenoid operated valve, said controller effective to close said solenoid operated valve and stop the supply of fuel gas to said heater when the temperature of the catalytic reaction in said heater has reached a predetermined level.

39. A method for controlling the heating of a catalytic heater having a catalyst pad and an adjacent diffusion pad within an enclosure having an open front face defining a catalyst pad flow through area, said method comprising:

mounting a starter within said catalyst pad for preheating said catalyst pad, said starter having a wattage of less than about 15 watts;

providing the starter with a cross-sectional area less than 2% of the catalyst pad flow through area;

supplying a fuel gas to said heater for passing through said diffusion pad and said catalyst pad for mixture with air from said open front face of said enclosure; and stopping the supply of electrical energy to said starter upon heating of said catalyst pad to a selected temperature.

40. The method as defined in claim 29, further comprising:

mounting said starter completely within said catalyst pad and spaced from said diffusion pad.

41. The method as defined in claim 39, wherein the catalyst pad has a rectangular shape and said starter extends within a side of said catalyst pad a distance less than about ⅓ of spacing between said side and an opposing side of said catalyst pad.

42. The method as defined in claim 39, further comprising:

providing a temperature sensor to sense the temperature of the catalytic reaction; and stopping the supply of electrical power to said starter in response to the temperature sensor.

43. The method as defined in claim 39, further comprising:

providing a solenoid operated valve to control the supply of fuel gas to said heater; and controlling electrical energy to said solenoid operated valve to close said solenoid operated valve and stop the supply of fuel gas to said heater.

44. The method as defined in claim 39, further comprising:

providing a timer for said source of electrical energy to said starter for ceasing the supply of electrical energy to said starter after a selected time period.

45. A catalytic heater fueled by a combustible gas source, comprising:

a housing defining an enclosure having an open front face;

a fuel inlet line having a fuel discharge within a rear portion of said enclosure;

a diffusion pad within said enclosure spaced between said open front face and said fuel discharge, a rear face of said diffusion pad being supplied with fuel gas for providing a catalytic reaction;

a catalyst pad spaced opposite said fuel inlet line relative to said diffusion pad and positioned within said enclosure adjacent said open front face, said catalyst pad having a rear face adjacent a front face of said diffusion pad and a front face exposed to ambient air from said open front face of said enclosure; and an electrically powered starter for preheating said catalyst pad for a time interval of less than about 60 seconds, said starter being positioned within a pocket extending from an entrance opening in a side face of said catalyst pad, a majority of said pocket being spaced from said diffusion pad.

46. The catalytic heater as defined in claim 45, wherein said pocket is enclosed by said catalyst pad.

47. The catalytic heater as defined in claim 45, further comprising:

a perforated plate adjacent the rear face of said diffusion pad, whereby a fuel gas is supplied to said perforated plate for passing through said diffusion pad.

48. The catalytic heater as defined in claim 45, further comprising:

a fuel gas chamber within said enclosure adjacent said perforated plate, said fuel discharge positioned within said chamber for passing through said perforated plate.

49. The catalytic heater as defined in claim 45, wherein said catalyst pad has a rectangular shape and said starter extends within a side of said catalyst pad a distance less than about ⅓ a spacing between said side and an opposing side of said catalyst pad.

50. The catalytic heater as defined in claim 45, wherein the starter has a width less than about 80% of a thickness of the catalyst pad.

51. The catalytic heater as defined in claim 45, further comprising:

a portable source of electrical energy adjacent said housing to supply electrical energy to said starter for preheating of said catalyst pad.

52. The catalytic heater as defined in claim 51, further comprising:

a timer for said source of electrical energy to supply electrical energy to said starter for a selected time period sufficient to heat the catalytic pad to a selected temperature.

53. The catalytic heater as defined in claim 45, further comprising:

a solenoid operated valve to control the supply of gas from said pipeline to said fuel gas chamber.

54. The catalytic heater as defined in claim 53, further comprising:

a controller to permit a selected supply of electrical energy to said solenoid operated valve, said controller effective to close said solenoid operated valve and stop the supply of fuel gas to said heater when the temperature of the catalytic reaction in said heater has reached a predetermined level.

55. A method for controlling the heating of a catalytic heater having a catalyst pad and an adjacent diffusion pad within an enclosure having an open front face defining a catalyst pad flow through area, said method comprising:

mounting a starter within said catalyst pad for preheating said catalyst pad, said starter having a wattage of less than about 15 watts;

powering the starter for a time interval of less than about 60 seconds for preheating the catalyst pad;

supplying a fuel gas to said heater for passing through said diffusion pad and said catalyst pad for mixture with air from said open front face of said enclosure; and stopping the supply of electrical energy to said starter upon heating of said catalyst pad to a selected temperature.

56. The method as defined in claim 55, further comprising:

mounting said starter completely within said catalyst pad and spaced from said diffusion pad.

57. The method as defined in claim 55, further comprising:

providing the starter with a cross-sectional area less than 2% of the catalyst pad flow through area.

58. The method as defined in claim 55, wherein the catalyst pad has a rectangular shape and said starter extends within a side of said catalyst pad a distance less than about ⅓ of spacing between said side and an opposing side of said catalyst pad.

59. The method as defined in claim 55, further comprising:

providing a temperature sensor to sense the temperature of the catalytic reaction; and stopping the supply of electrical power to said starter in response to the temperature sensor.

60. The method as defined in claim 55, further comprising:

providing a solenoid operated valve to control the supply of fuel gas to said heater; and controlling electrical energy to said solenoid operated valve to close said solenoid operated valve and stop the supply of fuel gas to said heater.

61. The method as defined in claim 55, further comprising:

providing a timer for said source of electrical energy to said starter for ceasing the supply of electrical energy to said starter after a selected time period.

62. The method as defined in claim 55, further comprising:

providing less than about 15 watts of electrical energy to said starter.

* * * * *